United States Patent [19]

Hix, Jr.

[11] 3,981,154

[45] Sept. 21, 1976

[54] SYSTEM FOR RECOVERING PETROLEUM FLUIDS FROM UNDERWATER FISSURES

[75] Inventor: Charles M. Hix, Jr., Bryan, Tex.

[73] Assignee: Arcadia Refining Company, Tyler, Tex.

[22] Filed: Mar. 27, 1970

[21] Appl. No.: 23,343

Related U.S. Application Data

[63] Continuation-in-part of Ser. No. 879,653, Nov. 25, 1969, Pat. No. 3,675,427.

[52] U.S. Cl. ..... 61/101; 61/1 F

[51] Int. Cl.[2] ..... E02B 15/04

[58] Field of Search ..... 61/.5, 1 F, 46, 72.3; 137/236; 210/242, DIG. 21

[56] References Cited

UNITED STATES PATENTS

| | | | |
|---|---|---|---|
| 2,940,266 | 6/1960 | Smith | 61/46 X |
| 3,339,512 | 9/1967 | Siegel | 61/.5 X |
| 3,389,559 | 6/1968 | Logan | 61/1 F |
| 3,429,128 | 2/1969 | Stafford et al. | 61/46 X |
| 3,435,793 | 4/1969 | Shurtleff | 61/46 X |
| 3,472,033 | 10/1969 | Brown | 61/46 |
| 3,500,841 | 3/1970 | Logan | 61/72.3 X |
| 3,518,836 | 7/1970 | Itokawa | 61/46 |
| 3,548,605 | 12/1970 | Paull et al. | 61/46 X |
| 3,610,194 | 10/1971 | Siegel | 61/1 F X |
| 3,653,215 | 4/1972 | Crucet | 61/1 F |
| 3,664,136 | 5/1972 | Laval et al. | 61/1 F |
| 3,666,100 | 5/1972 | Madej | 210/DIG. 21 |

FOREIGN PATENTS OR APPLICATIONS

| | | | |
|---|---|---|---|
| 860,130 | 9/1940 | France | 61/.5 |

*Primary Examiner*—Paul R. Gilliam
*Assistant Examiner*—David H. Corbin
*Attorney, Agent, or Firm*—Lane, Aitken, Dunner & Ziems

[57] ABSTRACT

A system for recovering petroleum fluids from underwater fissures, wherein a tank formed of a cylindrical wall having a top closure and an open bottom is adapted to be positioned over the fissure on or near the bed of water without any rigid restraints. The spilled fluids from the fissure will enter the open bottom and pass upwardly toward the top closure where they are stored for later withdrawal. A method for recovering petroleum fluids from underwater fissures.

1 Claim, 6 Drawing Figures

INVENTOR
CHARLES M. HIX, Jr.

BY Lane, Aitken Dunner & Ziems
ATTORNEYS

FIG.4.
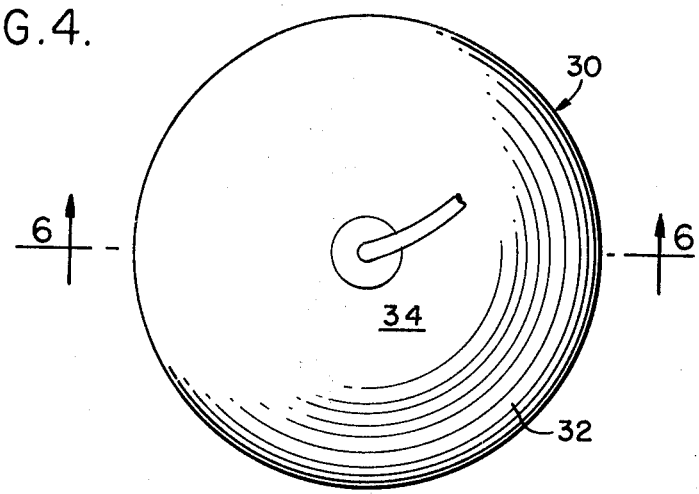
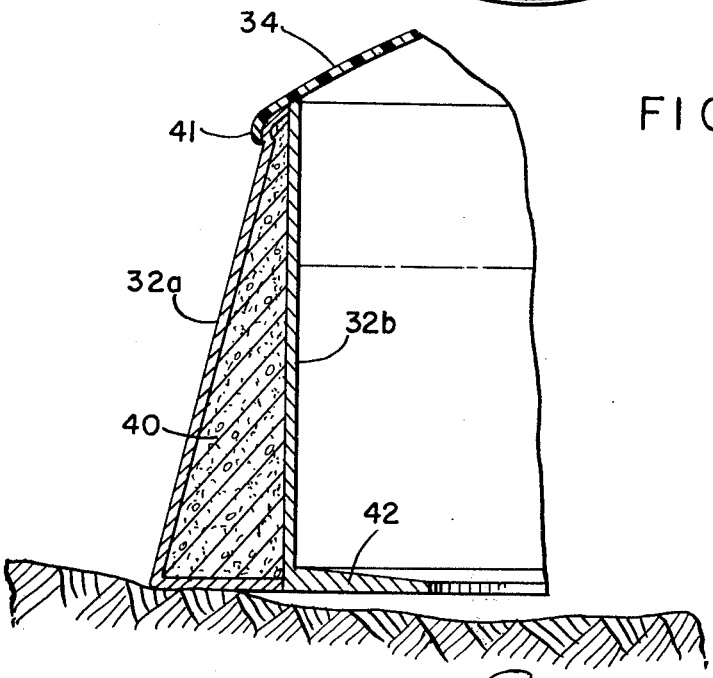
FIG.5.
FIG.6.
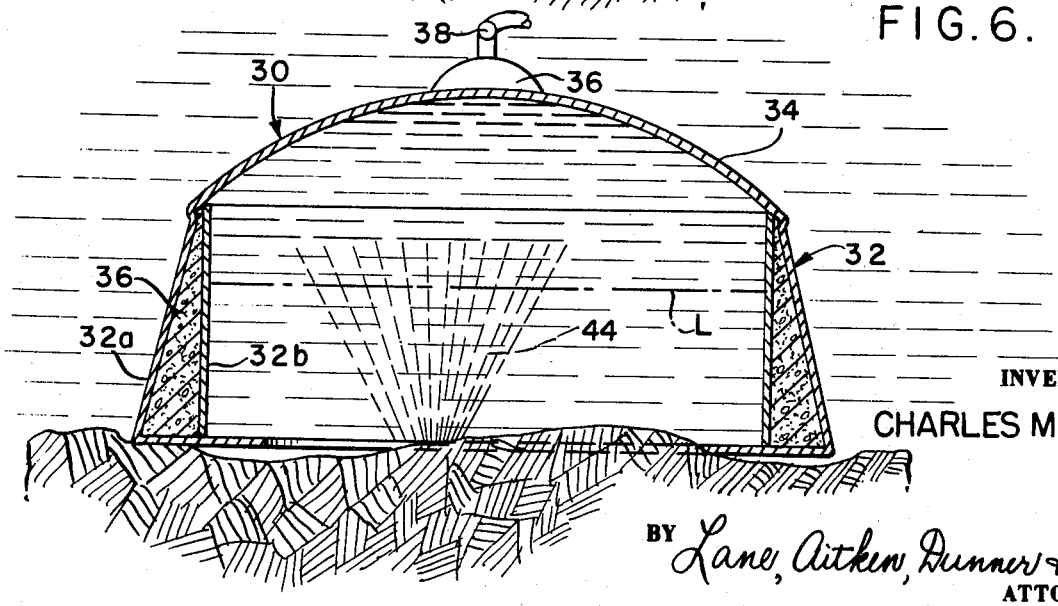
INVENTOR
CHARLES M. HIX, Jr.
BY Lane, Aitken, Dunner & Ziems
ATTORNEYS

SYSTEM FOR RECOVERING PETROLEUM FLUIDS FROM UNDERWATER FISSURES

REFERENCE TO RELATED APPLICATION

This application is a continuation-in-part of application Ser. No. 879,653 entitled "Underwater Storage Device", filed Nov. 25, 1969, now U.S. Pat. No. 3,675,427.

BACKGROUND OF THE INVENTION

This invention relates to a system for recovering petroleum products, such as oil, from underwater fissures.

Prior to the present invention it was extremely difficult, if not impossible, to recover the spillage of oil and gas from underwater fissures occurring both naturally and as a result of the drilling of an oil or gas well. Recovery of the oil is essential to prevent severe polution of the water.

SUMMARY OF THE INVENTION

It is therefore an object of the present invention to provide a system for recovering petroleum fluids from underwater fissures which may be easily transported to or from the desired location.

Toward the fulfillment of these objects, the system of the present invention comprises a large tank formed of a generally cylindrical wall having a top closure and an open bottom for the entrance of the fluids. The tank filled with water is positioned over the area on the bottom of the body of water from which the petroleum fluid is flowing. The petroleum fluid will collect in the tank and displace the water contained by the tank and the pollution of the surrounding body of water is prevented.

BRIEF DESCRIPTION OF THE DRAWINGS

Reference is now made to the accompanying drawings for a better understanding of the nature and objects of the present invention. The drawings illustrate the best mode presently contemplated for carrying out the objects of the invention and are not to be construed as restrictions or limitations on its scope.

In the drawings:

FIGS. 4, 5 and 6 are views similar to FIGS. 1, 2 and 3, respectively, but depicting another embodiment of the system of the present invention.

DESCRIPTION OF THE PREFERRED EMBODIMENTS

Figure 1:
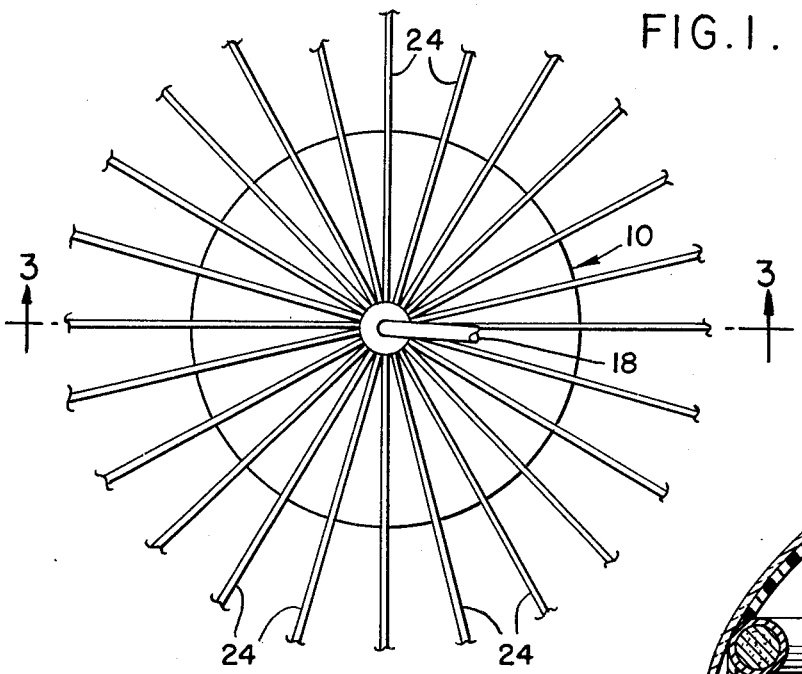
FIG. 1 is a plan view of the underwater recovery system of the present invention.
Figure 2:
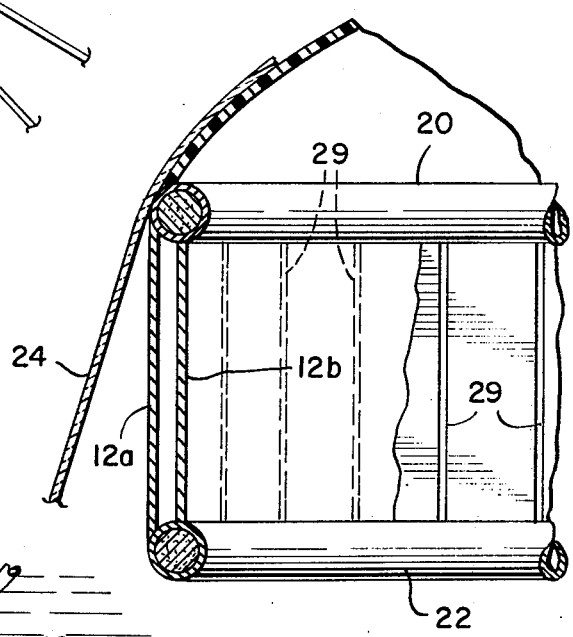
FIG. 2 is an enlarged partial sectional view of the device of FIG. 1.
Figure 3:
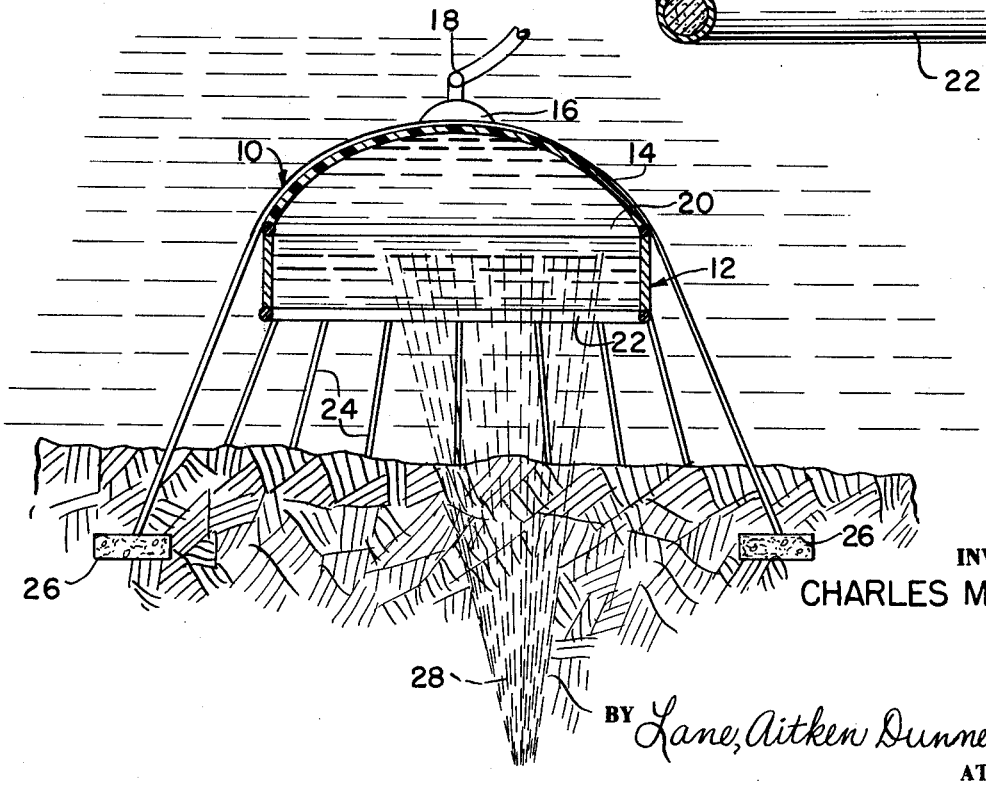
FIG. 3 is a cross-sectional view taken along the line 3—3 of FIG. 1, showing the device disposed underwater and over a fissure.

Referring specifically to the embodiment of FIGS. 1–3, the reference numeral 10 refers in general to a tank formed of a generally cylindrical wall 12, and a flexible dome 14 enclosing the top of the wall. A rigid top portion 16 is fixed to the central portion of the dome 14, and receives an outlet connection 18 which extends through it and the dome 14.

A pair of solid compression rings 20 and 22 are formed at the ends of the wall 12 in order to resist compressive stresses that occur, and to add stability to the tank.

A plurality of flexible cables 24 are attached to the top portion 16, and extend along the flexible dome 14 and outwardly from the tank 10, whereby they are connected to a plurality of anchors 26 embedded in the water bed. Alternatively, instead of embedded anchors, dead weight anchors or piles driven in the ocean floor may be used. Anchors are preferable because piles may not be able to resist the forces applied thereto.

As better shown in FIG. 2, the wall 12 is formed of a pair of cylindrical sheets 12*a* and 12*b* which are spaced apart, and which are divided into a series of vertical watertight buoyant chambers by a plurality of partitions 29 extending around the circumference of the wall at spaced intervals. The chambers thus formed not only permit the tank 10 to float in water when little or no petroleum fluids are contained in the tank, but increase the section modulus of the wall 12.

As shown in FIG. 3, the tank 10 is submerged and filled with water from the surrounding body of water, and will be buoyantly suspended by virtue of the buoyant chambers defined by the partitions 29 and by the cables 24. The tank is positioned over the area from which the petroleum fluids are flowing due to a fissure. The petroleum fluids, shown by the reference numeral 28, seeping upwardly from the fissure will pass into the open bottom and gravitate upwards in the tank towards the top of the flexible dome 14, since they are lighter than water. An interface between the petroleum fluids and the water will thus occur along a line within the tank. The petroleum fluids contained in the tank will add to its buoyancy, thus increasing the tension in the cables 24. The petroleum fluids may be later withdrawn from the tank through the outlet connection 18.

In the embodiment of FIGS. 4–6, a tank 30 is provided which consists of a cylindrical wall portion 32 and a flexible dome 34. As in the previous embodiment a rigid top portion 36 is fixed to the flexible dome 34, and an outlet connection 38 is provided which extends through the dome 34 and the top section 36. The tank is not fixed to the sea bed but merely rests on the sea bed maintained in place substantially only be gravity.

As better shown in FIG. 5, the wall portion 32 is formed by a pair of cylindrical sheets 32*a* and 32*b*, with the sheet 32*a* extending at an angle with respect to the sheet 32*b*. These sheets are spaced apart as shown to provide a form for casting concrete, shown by the reference numeral 40. The sheets define an enlarged portion 41 at the top of the cylindrical wall, which functions as a compression ring to resist the compressive forces applied at this point as a result of the buoyant force of the petroleum fluids on the dome 34. The bottom end of the tank 30 is open, and a rigid fiberglass skirt 42 is provided to cut off the flow of water around the bottom to prevent scour.

With the submerged tank 30 filled with water and placed over the area from which petroleum fluids 44 from a fissure are flowing, the petroleum fluids will gravitate to the upper portion of the tank to displace the water therein and the interface between the petroleum fluids and the water will be formed within the tank as shown, for example, by the line L. The petroleum fluids may be later withdrawn from the tank through the outlet connection 38.

In each embodiment, since all of the petroleum fluid is collected in the tank, pollution of the body of water is effectively prevented.

Since the tanks of both embodiments are not rigidly attached to the bed of the water, they are therefore not susceptible to damage by earth displacements as well as water waves, etc. Preferably in both of the embodiments, the flexible domes 14 and 34 are made of neoprene reinforced with fiberglass and the rigid top portions 16 and 36 are made of a fiberglass reinforced polyester. In the embodiment of FIGS. 1–3, the wall sheets 12*a* and 12*b* are also preferably made of a fiberglass reinforced polyester and the rings 22 preferably comprise concrete cores enclosed in fiberglass reinforced polyester sheets. In the embodiment of FIGS. 4–6, the sheets 32*a* and 32*b* are preferably made of fiberglass.

The structure of both embodiments can be constructed onshore and would still be light enough to be floated to the site and lowered to the water bed either by adding weight to, or by positioning anchors around, the structure. In the case of the embodiment of FIGS. 4–6, the concrete formed between the walls could be poured on site, which also facilitates transfer and assembly.

Several variations may be made in the foregoing without departing from the basic scope of the invention. For example, the size and shape of the tanks may vary in accordance with the particular requirements. In this regard, if the water is shallow, a long horizontal cylindrical tank with a flat dome may serve best, whereby, in deep water a tall vertical cylindrical wall with a spherical or ellipsoidal top may be more desirable. Instead of using a flexible dome top, the dome may be rigid. Inlet connections may be provided through the tanks for directly introducing petroleum fluids and/or water for storage purposes.

Of course, other variations of the specific construction and arrangement of the invention disclosed above can be made by those skilled in the art without departing from the invention as defined in the appended claims.

I claim:

1. A method for recovering fluids lighter than water escaping from an underwater fissure in the bed of a body of water, comprising the steps of completely submerging in said body of water a tank large enough to form an underwater pool capable of receiving and accumulating a large volume of said escaping fluids, said tank having an open bottom, substantially filling said tank with water, positioning said tank while substantially filled with water generally vertically above the fissure to first receive fluid escaping from said fissure after said tank is completely submerged so that said escaping fluid is recovered by rising upwardly in the said tank through the bottom thereof and displacing the water in said tank, making said tank buoyant, bouyantly suspending said tank above said fissure out of engagement with the underwater surface, accumulating said escaping fluid in said tank in a pool submerged completely underwater while said tank is buoyantly suspended submerged completely under water, and anchoring said tank from said underwater surface to maintain said tank in a substantially fixed position.

* * * * *